US012654079B2

(12) United States Patent
Thornton

(10) Patent No.: US 12,654,079 B2
(45) Date of Patent: Jun. 16, 2026

(54) PICKLEBALL PADDLE PROTECTIVE SLEEVE FOR A GLOBAL POSITIONING DEVICE TO BE ENCLOSED FOR TRACKING CAPABILITIES

(71) Applicant: Christopher Clice Thornton, Brandon, FL (US)

(72) Inventor: Christopher Clice Thornton, Brandon, FL (US)

( * ) Notice: Subject to any disclaimer, the term of this patent is extended or adjusted under 35 U.S.C. 154(b) by 0 days.

(21) Appl. No.: 18/748,638

(22) Filed: Jun. 20, 2024

(65) Prior Publication Data

US 2025/0387684 A1 Dec. 25, 2025

(51) Int. Cl.
*A63B 60/16* (2015.01)
*A63B 102/08* (2015.01)

(52) U.S. Cl.
CPC ..... *A63B 60/16* (2015.10); *A63B 2102/08* (2015.10); *A63B 2220/12* (2013.01)

(58) Field of Classification Search
CPC ..... A63B 60/16; A63B 60/14; A63B 2102/08
See application file for complete search history.

(56) References Cited

U.S. PATENT DOCUMENTS

| | | | | |
|---|---|---|---|---|
| 9,724,578 | B2 * | 8/2017 | Zhao | A63B 60/00 |
| 2015/0362331 | A1 * | 12/2015 | Sanchez | A63B 53/14 702/153 |
| 2020/0078648 | A1 * | 3/2020 | Steel, Jr. | A63B 59/50 |
| 2023/0158382 | A1 * | 5/2023 | Park | A63B 60/16 473/299 |
| 2023/0218962 | A1 * | 7/2023 | Lee | F41B 5/1484 473/223 |
| 2023/0417923 | A1 * | 12/2023 | Newman | G01S 19/01 |

* cited by examiner

*Primary Examiner* — Jason L Vaughan
*Assistant Examiner* — Amanda Kreiling

(57) ABSTRACT

The present invention is a protective sleeve for pickleball paddles that enhances security and facilitates tracking. Most pickleball paddles today lack integrated solutions for preventing loss or theft. This sleeve accommodates a tracking device or GPS tracker, within its durable silicone construction. The design ensures the tracker is securely enclosed while remaining unobtrusive to the player's grip and performance. This innovation lets players quickly locate their paddles if misplaced, lost, or stolen, providing peace of mind and reducing the likelihood of paddle loss.

5 Claims, 3 Drawing Sheets

PICKLEBALL PADDLE PROTECTIVE SLEEVE FOR A GLOBAL POSITIONING DEVICE TO BE ENCLOSED FOR TRACKING CAPABILITIES

FIELD OF DISCLOSURE

The present invention relates to the design of sports equipment accessories, specifically a protective sleeve for pickleball paddles that is designed to securely house a tracking device to prevent loss and theft of the paddle.

BACKGROUND

Existing pickleball paddles are typically stored without additional protective or tracking mechanisms, making them susceptible to being misplaced or stolen. While various methods exist for monitoring personal belongings, they do not specifically address the unique needs and handling of sports equipment like pickleball paddles. Most tracking solutions are either attached in a cumbersome way or are not integrated into the sports equipment; thus, they can be easily dislodged during active use. The protective sleeve proposed in this invention secures the tracking device within a flexible, durable silicone housing that conforms to the handle of the paddle and maintains the player's usability and comfort.

SUMMARY

The present invention improves upon existing methods of securing and tracking sports equipment, specifically pickleball paddles, by providing a protective sleeve that houses a tracking device. This is accomplished by designing a flexible, durable silicone sleeve that fits snugly over the paddle's handle. Inside the sleeve is a specialized compartment that securely encloses a tracking device such as an Air Tag®, Chipolo®, Tile® Sticker, or another type of Global Positioning System (GPS) tracker. This compartment is engineered to keep the device in place even during vigorous play, ensuring constant tracking capability without interfering with the functionality or comfort of the paddle's grip.

In some aspects, the techniques described herein relate to a protective sleeve for a paddle or racket, the protective sleeve including: a body adapted to fit over an end of a grip of the paddle or racket; and the body having an integrated compartment designed to enclose and secure a tracking device.

In some aspects, the techniques described herein relate to a protective sleeve, wherein the protective sleeve is made of a flexible material.

In some aspects, the techniques described herein relate to a protective sleeve, wherein the flexible material is silicone.

In some aspects, the techniques described herein relate to a protective sleeve, wherein the protective sleeve has a base that extends upward into a circular sidewall that extends upward into a top opening that provides access to a hollow interior of the body to receive the tracking device.

In some aspects, the techniques described herein relate to a protective sleeve, wherein the top opening is of smaller area than the base.

In some aspects, the techniques described herein relate to a protective sleeve, wherein the protective sleeve is provided in different colors.

In some aspects, the techniques described herein relate to a method of tracking a paddle or racket: the method including: positioning a tracking device into a protective sleeve, wherein the protective sleeve has integrated compartment designed to enclose and secure the tracking device; and positioning the protective sleeve over an end of a grip of the paddle or racket.

In some aspects, the techniques described herein relate to a method, the method including: stretching the protective sleeve over the grip wherein the protective sleeve is made of a flexible material.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
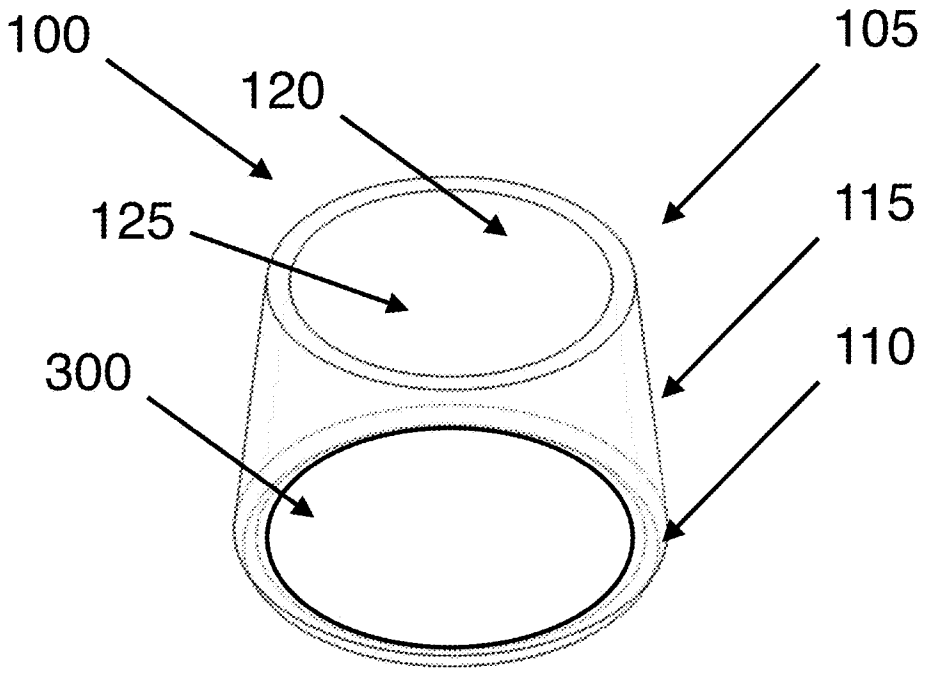
FIG. 1 shows a perspective view of the protective sleeve.

The following description and drawings are illustrative and are not to be construed as limiting. Numerous specific details are described to provide a thorough understanding of the disclosure. However, in certain instances, well-known or conventional details are not described in order to avoid obscuring the description. References to one or another embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skills in the art to which this disclosure pertains.

The present invention provides a new type of sports equipment accessory that has been created, allowing pickleball or other racket sports players to securely attach a tracking device to their paddles, mitigating the risk of loss or theft. In traditional setups, nothing prevents paddles or rackets from being misplaced or stolen. The present invention solves this problem by incorporating a tracking device within a protective sleeve that does not interfere with the gameplay or handle comfort.

While there are several ways to implement the tracking device protective sleeve, the preferred implementation uses a high-grade, flexible silicone material that contours seamlessly to the paddle or racket's handle. The sleeve features an integrated pocket designed to enclose a tracking device securely. This pocket is engineered with a tight seal to prevent the tracking device from dislodging during gameplay.

Figure 2:
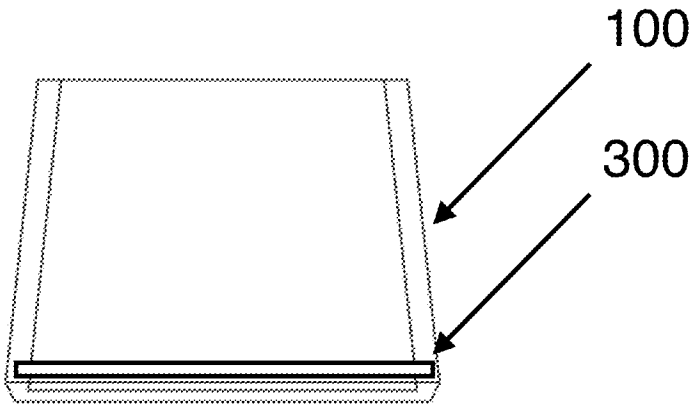
FIG. 2 shows a front view of the protective sleeve.
Figure 3:
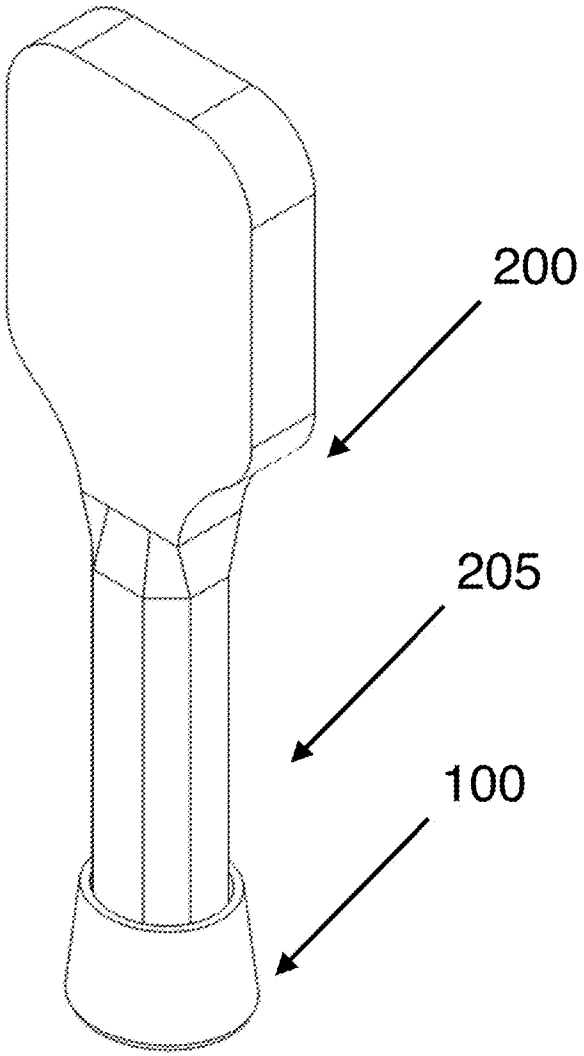
FIG. 3 shows an illustration of the protective sleeve on the grip of the racket.

FIGS. 1-3, depicts one embodiment of protective sleeve 100 in accordance with the embodiments of the present invention that is connected to a grip of a paddle or racket 200 (FIG. 3) and holds a tracking device 300 (FIG. 1-2) such that a user may be able to track paddle or racket 200 using a remote computing device 400. Paddle or racket 200 may refer to any sports equipment apparatus such as but not limited to a pickleball paddle, a tennis racket, a squash racket, a badminton racket, a table tennis paddle, or even other types of sports equipment such as a baseball bat, hockey stick, cricket bat. Remote computing device 400 may refer to any number of phones, tablets, gaming consoles, laptops, notebooks, desktops, routers, or any device capable of communicating and providing directions to locate tracking device 300.

Protective sleeve 100 may have a body 105 having a base 110 that extends upward into a circular sidewall 115 which then extends upward into a top opening 120 at an opposite end of base 110 which provides access to a hollow interior 125 of protective sleeve 100. Base 110 and top opening 120 may be circular in shape whereby base 110 may have a larger diameter and circumference than top opening 120 such that sidewall 115 decreases in width and cross-sectional area as sidewall 115 extends upward. In other non-limiting embodiments, protective sleeve 100 may have a different shape to accommodate for different sized and shaped rackets or paddles or tracking devices. Protective sleeve 100 may have different colors and styles and patterns to match with or contrast paddle or racket 200.

Sleeve 100 may be made of a flexible silicon material. However, this is non-limiting and may be made of other materials such as thermoplastic elastomers, polyurethane, neoprene, EPDM rubber, fluorosilicate, latex rubber, nitrile rubber, or other materials that do not stray away from the present invention.

Integrated into the sleeve's 100 structure may be a designated compartment or area that is specially designed to accommodate the size of tracking device 300. Tracking device 300 may be any known device known to those of ordinary skill in the market such as an Air Tag®, Chipolo®, Tile® Sticker, or another type of GPS tracker. Tracking device 300 may be placed near the base 110 whereby hollow interior 125 may provide a friction fit with tracking device 300, ensuring easy access while maintaining the sleeve's streamlined appearance. Tracking device 300 may be positioned inside of protective sleeve 100 by grabbing protective sleeve 100 and stretching top opening 120 and sidewalls 115 to a larger diameter. The user may then place the tracking device into hollow interior 125 near base 110 and then releasing protective sleeve 100.

To install protective sleeve 100 on paddle or racket 200, as illustrated in FIG. 5, the user may stretch protective sleeve 100 and position protective sleeve 100 over grip 205 of a paddle or racket 200 such that base 110 of protective sleeve 100 is positioned at or near a base of grip 205 with tracking device 300 secured safely between them. The user may then release protective sleeve 100 such that protective sleeve 100 forms a tight grip over grip 205. When the user no longer needs to track paddle or racket 200 or needs to replace the batteries in tracking device 300, they may once again stretch protective sleeve 100 and remove protective sleeve 100 from grip 205 of paddle or racket 200.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A protective sleeve for a paddle or racket, the protective sleeve comprising:

a body adapted to fit over an end of a grip or handle of the paddle or racket; and the body having an integrated compartment designed to enclose and secure a tracking device, wherein the protective sleeve has a base that extends upward into a circular sidewall that extends upward into a top opening that provides access to a hollow interior of the body to receive the tracking device, wherein the circular sidewall provides a smooth, continuous taper from the base to the top opening.

2. The protective sleeve of claim 1, wherein the protective sleeve is made of a flexible material, that contours seamlessly to the grip or handle.

3. The protective sleeve of claim 2, wherein the flexible material is silicone.

4. The protective sleeve of claim 1, wherein the protective sleeve is provided in different colors.

5. A universal protective sleeve for sports equipment tracking, comprising: a flexible body adapted to removably attach to and fit over a handle portion of a paddle or racket; an integrated compartment within the flexible body dimensioned to accommodate a range of commercially available tracking devices, wherein the integrated compartment provides flexible retention configured to securely hold any tracking device through adjustable friction fit, wherein the universal protective sleeve has a base that extends upward into a circular sidewall that extends upward into a top opening that provides access to a hollow interior of the flexible body to receive a tracking device of the range of commercially available tracking devices, wherein the circular sidewall provides a smooth, continuous taper from the base to the top opening.

* * * * *